US006213759B1

(12) United States Patent
Sung

(10) Patent No.: US 6,213,759 B1
(45) Date of Patent: Apr. 10, 2001

(54) DISPOSABLE UTILITY LIGHTER WITH CHILD RESISTANT DEVICE

(75) Inventor: Kil Yong Sung, Ontario, CA (US)

(73) Assignee: Calico Brands, Inc., Ontario, CA (US)

( * ) Notice: Subject to any disclaimer, the term of this patent is extended or adjusted under 35 U.S.C. 154(b) by 0 days.

(21) Appl. No.: 09/310,539

(22) Filed: May 12, 1999

Related U.S. Application Data

(63) Continuation-in-part of application No. 09/236,987, filed on Jan. 26, 1999, now abandoned, which is a continuation of application No. 08/997,029, filed on Dec. 23, 1997, now abandoned.

(51) Int. Cl.[7] ..... F23D 11/36
(52) U.S. Cl. ..... 431/153; 431/255; 431/345
(58) Field of Search ..... 431/344, 153, 431/255, 345

(56) References Cited

U.S. PATENT DOCUMENTS 4,786,248 * 11/1988 Nitta ..... 431/153
5,531,592 * 7/1996 Tasi ..... 431/255
5,697,775 * 12/1997 Saito et al. ..... 431/153
6,012,916 * 1/2000 Liang ..... 431/255

* cited by examiner

*Primary Examiner*—Carl D. Price
(74) *Attorney, Agent, or Firm*—David O'Reilly

(57) ABSTRACT

A disposable utility lighter for lighting BBQS, fireplaces and the like, having a child resistant device comprised of a reservoir, a spark generator for generating spark at a nozzle tip to ignite the flame by activating a trigger. Four embodiments of a child resistant device are disclosed that prevent use by children comprising buttons or switches that must first be manipulated before the lighter can be operated. In a first embodiment, the trigger release button is mounted beneath a trigger guard immediately adjacent to and above the trigger. The trigger release button allows one finger operation to pull or push upward on the trigger release button, and then nearly simultaneously pull back on the trigger. Release of the trigger re-engages the trigger release button preventing operation. In a second embodiment, a downward pressure on a trigger locking button extending through the top of the housing of the BBQ lighter disengages an abutment from the boss on the trigger allowing operation of the trigger. A third embodiment includes a trigger on/off switch and a lighter fluid flow control lever that must be operated to allow the utility lighter to ignite. In a fourth embodiment the trigger releases fuel while an opposite force on an ignition button is required to ignite the fuel.

2 Claims, 7 Drawing Sheets

DISPOSABLE UTILITY LIGHTER WITH CHILD RESISTANT DEVICE

This Application is a Continuation-In-Part of application Ser. No. 09/236,987 filed Jan. 26, 1999 now abandoned which is a Continuation of application Ser. No. 08/997,029 filed Dec. 23, 1997, now abandoned.

BACKGROUND OF THE INVENTION

1. Field of the Invention

This invention relates to safety devices for a utility lighter used to light barbecues (BBQs) and fireplaces and the like; and more particularly, relates to a child resistant safety device for such lighters.

2. Background Information

Many different BBQ and fireplace utility lighters are available on the market. Generally, these devices have a reservoir with a flammable fluid in the handle, and a trigger to generate an electric spark to ignite the fluid at a nozzle tip. The fluid is released to the nozzle tip and ignited by an electrical spark generated by a piezoelectric cartridge or similar device in the handle of the lighter.

An elongated handle and nozzle, on these devices, keep the flame well away from the user. Further, the elongated construction allows the device to be used to ignite BBQs, fireplaces, etc. without getting near the flame. A disadvantage of these devices is that they appear very much like toys, and are attractive to children who could accidentally start a fire or injure themselves by improper use.

To light the flame, a lighter fluid such as butane is released when the trigger is operated and flows to the nozzle tip. As the trigger reaches near the end of its travel, a spark generator is activated, generating a spark at the nozzle tip causing the lighter fluid to ignite. Usually the device for generating the spark is a piezoelectric or the like that is activated by the trigger nearly simultaneously with release of the fluid. A regulator on the device, regulates the size of the flame by regulating the flow of the lighter fluid. This device can then be easily used to ignite a BBQ, fireplace, candles or any other item where a match would be used.

For safety reasons, attempts have been made to incorporate child resistance devices into these disposable lighters and similar devices such as cigarette lighters. Usually these devices are constructed to prevent the flow of ignition fluid or lock the trigger. Most of the device conceived are designed to provide sufficient resistance to prevent or deter use by children while at the same time being inconvenient to use. On/off switches or devices that lock the trigger can be effective to prevent operation. However, children can often figure out how these devices work and easily unlock the trigger. Another disadvantage of this type of safety device is that the user must remember to turn off or relock the trigger after use. This is an inconvenience. It would be preferable if a more effective method to disable the utility lighter could be provided.

Therefore, it is one object of the present invention to provide a utility lighter for BBQs and fireplaces that have a child resistant device that prevents operation of the trigger.

Still another object of the present invention is to provide a child resistant device for a utility lighter for BBQs or fireplaces that discourages use by children.

Still another object of the present invention is to provide an improved child resistant safety device for a utility BBQ lighter that has a release button and trigger that can be simultaneously operated with one finger.

Still another object of the present invention is to provide a child resistant device for a utility lighter that automatically relocks the trigger when the child resistant safety device is released.

Still another object of the present invention is to provide a child resistant device for a utility lighter including a button at the top of the device that must be operated and held while the trigger is being operated.

Still another object of the present invention is to provide a child resistant device for a utility lighter having a trigger release button on top of the handle, sufficient spaced from the trigger to allow use with one hand by an adult, but is difficult to manipulate by children.

Yet another object of the present invention is to provide a child resistant device for a disposable utility lighter that has separate controls for the ignition trigger and the lighter fluid.

Still another object of the present invention is to provide an operating lever to independently operate a valve to release before fluid in a disposable utility lighter.

Yet another object of the present invention is to provide a child resistant utility lighter having a separate valve operating lever for releasing lighter fluid that extends through an upper portion of the lighter housing adjacent a lighter flow control regulator dial.

Still another object of the present invention is to provide a child resistant utility lighter having a trigger for releasing fuel that must be held on while a separate ignition button is operated.

Yet another object of the present invention is to provide a child resistant utility lighter configured with a trigger for releasing fuel and a separately operated ignition button on top of the lighter for igniting the fuel.

Still another object of the present invention is to provide a child resistant utility lighter having separate fuel release and ignition buttons that operate sequentially.

BRIEF DESCRIPTION OF THE INVENTION

The purpose of the prevent invention is to provide a child resistant device for a utility lighter to light a BBQ or fireplace lighters that effectively prevents use by children, but is simple in construction and low in cost to manufacture. An elongate handle on the utility lighter serves as a housing for a lighter fluid reservoir and electric spark generator. An elongate nozzle extends outward from the handle to a nozzle tip. Lighter fluid is delivered from the reservoir to the tip by a tube. Operation of the trigger releases fluid to the tip which expands into a gas for ignition.

When the trigger is operated, a spark generator is activated to generate a spark at a spark gap at the nozzle tip. Generally, the spark generator is a piezoelectric cartridge used to ignite the fluid exiting the nozzle tip. The flow of fluid can be adjusted by the regulator dial that opens or closes a valve on the exit port of the lighter fluid reservoir. The regulator controls the size of the flame. The regulator allows ignition of a flame with minimum fluid. Adjustment of the flame can be achieved after the flame is ignited or prior to igniting the flame if there is difficulty of obtaining ignition. The regulator allows flow to be adjusted for optimum ignition and minimum use of lighter fluid.

In one embodiment of the invention, the child safety device is in the form of trigger release button mounted adjacent to and above the trigger. The trigger release button has a flange or abutment for engaging a plate on the trigger, preventing its operation until the release button is pressed. The advantage of having the trigger release button adjacent to the trigger is that the device can be operated with one finger, but requires considerable dexterity.

To operate this device a finger, such as the index finger, is placed on the trigger. The index finger is pressed upward to activate the release button and then simultaneously, the trigger is pulled back to release fluid and activate the spark generator. Release of the trigger also simultaneously releases the trigger release button, relocking the trigger and preventing use by children.

The trigger release button is mounted beneath the trigger guard immediately adjacent to and above the trigger. The trigger release button has a curved surface to fit the finger placed in the trigger guard, and a tubular portion, forming a socket for receiving a spring to bias the trigger release button into a locking position. A plate on the trigger release button extends rearward over a flange on the trigger, and has an abutment engaging the end of the trigger flange preventing its operation.

The trigger is slidably mounted in the lighter housing beneath the trigger guard, and has a socket for engaging the spark generator while also activating a valve to release fluid from the lighter fluid reservoir. The BBQ or fireplace lighter is constructed in a conventional manner. A reservoir, containing a lighter fluid, is mounted in the handle and has a valve for releasing lighter fluid through a tube into an elongate nozzle to the nozzle tip. A spark generator, mounted in the handle, has conductors connected to a spark gap mounted immediately adjacent to the nozzle tip. The trigger is constructed to release lighter fluid from the reservoir through the valve into the nozzle tip when activated. Continued activation of the trigger then generates a spark at the spark gap igniting the fluid at the nozzle tip in a conventional manner. A regulator, with an adjustable dial allows the amount of fluid released to the nozzle to be increased or decreased as desired. In this way, the size of the flame at the nozzle tip can be controlled.

In a second embodiment of the invention, the child resistant trigger release device is in the form of a button extending through a hole in the top of the BBQ lighter housing. The button is attached to a lever or rocker arm mounted on a pivot pin having an abutment, engaging a boss formed on a flange portion of the trigger. A spring biases the abutment into engagement with the trigger boss preventing operation of the trigger.

To release the trigger, the button is pushed downward causing a seesaw motion of the rocker arm, lifting and releasing the abutment from engagement with the boss on the trigger. This allows the trigger to slide backward, activating the fluid reservoir valve and nearly simultaneously, the spark gap generator. Thus, the sequence of operation is pushing down on the button to release the trigger lock; pull back on the trigger to open the fluid reservoir valve, allowing ignition fluid to flow to the nozzle tip; and nearly simultaneously activate the spark gap to ignite the fluid exiting a delivery tube at the nozzle tip, igniting a flame.

In this embodiment, the trigger locking and release mechanism is simple in construction and easy for an adult to use, but requires considerable dexterity, and will discourage use by children. Further, the trigger release button is preferably far enough away from the trigger that it would be difficult for a child to simultaneously reach the trigger and the trigger release button.

A child resistant device is provided in a third embodiment by an on/off switch which locks the trigger. In addition to the on/off switch, a valve lever is provided that must be manually operated to deliver fluid to the nozzle tip before the utility lighter will ignite. No lighter fluid will be allowed to flow to the nozzle tip until the valve lever is operated. Thus, to operate this embodiment, the switch must be turned on to release the trigger, the valve lever operated to release fluid to the tip, and then the trigger must be operated to ignite the fluid.

The valve flow control lever extends through the top of the utility lighter immediately adjacent to the flow control regulating dial. The flow control regulating dial controls the volume of fluid that flows from the lighter fluid reservoir to the nozzle tip while the valve lever open and closes the valve to start and stop the flow of lighter fluid to the nozzle tip.

A fourth embodiment of a child resistant utility lighter includes separately operated mechanisms for releasing fuel and igniting the fuel. In this embodiment, a button is provided for releasing fuel which must be held on while a second button is simultaneously operated to ignite the fuel. In the preferred arrangement of the invention, the fuel release button is coupled to the fuel reservoir release valve while the ignition button is on top of the lighter. This results in opposite motions for releasing fuel and igniting the fuel that would be difficult for a child to do even using two hands. However, an adult can easily manipulate this device by simultaneously holding the trigger in a fuel-release position while manipulating the fuel ignition button on top of the utility lighter. Thus the fourth embodiment incorporates mechanisms that are independently and oppositely operated which is a difficult manipulative task by a child.

The above and other novel features of the invention will be more fully understood from the following detailed description and the accompanying drawings, in which like reference number identify like parts throughout.

DETAILED DESCRIPTION OF THE INVENTION

Figure 1:
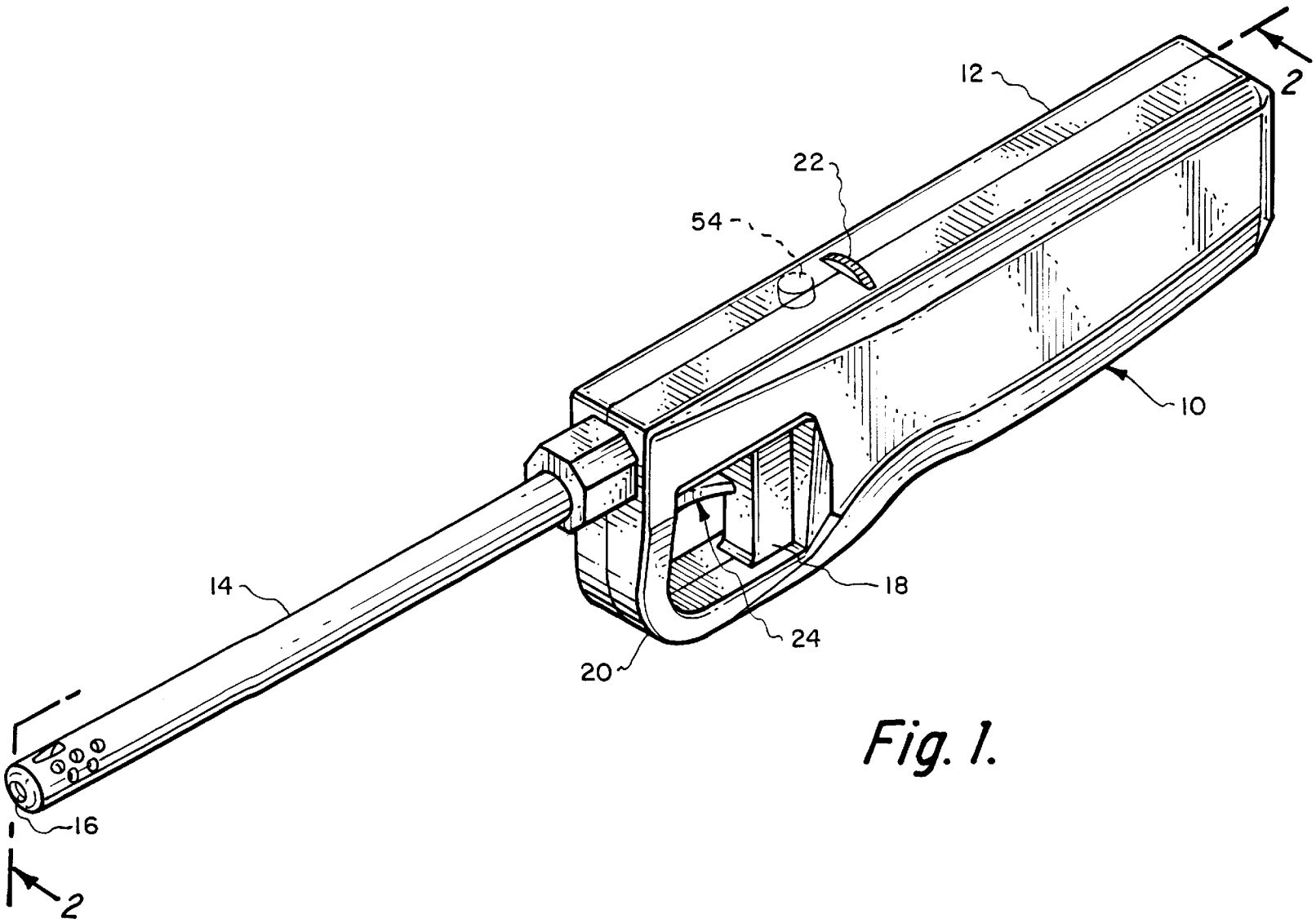
FIG. 1 is an isometric view of a first embodiment of a disposable utility lighter according to the invention with a second embodiment illustrated in phantom.

A utility lighter 10 is illustrated in the isometric view of FIG. 1. Disposable utility lighter 10 is conventional in construction except for the child resistant safety device. BBQ lighter 10 is comprised of a housing 12 having a nozzle 14 and nozzle tip 16, and trigger 18 beneath trigger guard 20 for igniting a flame. A flame is ignited by operation of a trigger 18 releases lighter fluid to nozzle tip 16 for ignition by a spark as will be described in greater detail hereinafter. Rotatable dial 22 adjusts the size of the flame at nozzle tip 16. In a first embodiment, a child release device is provided by a trigger lock and release mechanism 24, which will be described in greater detail hereafter.

Figure 2:
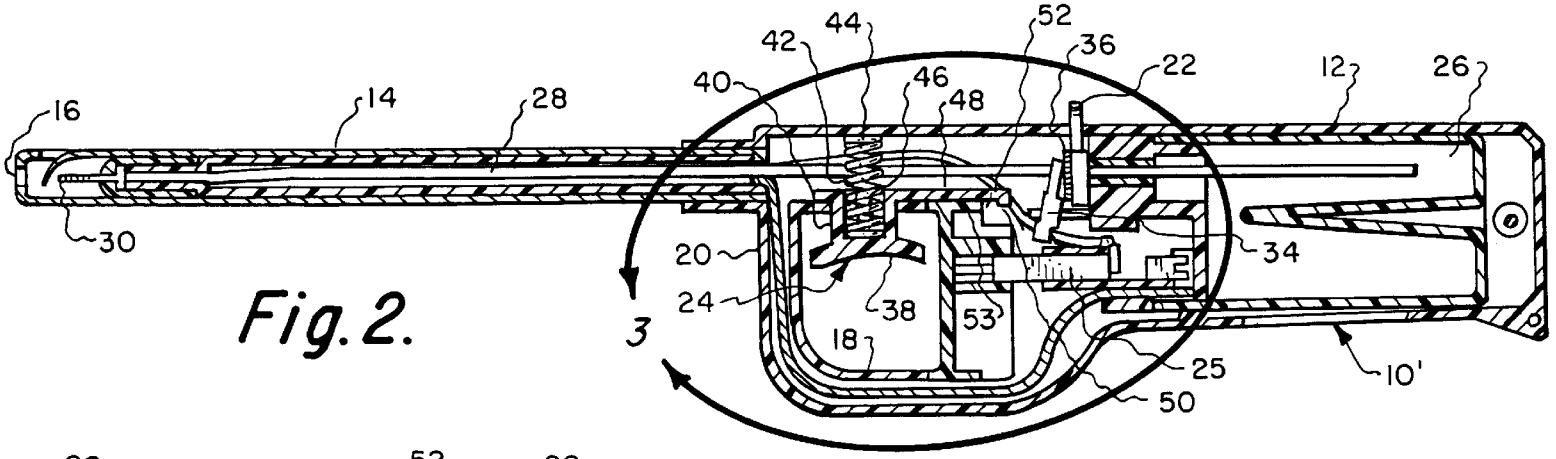
FIG. 2 is a sectional view illustrating the details of a first embodiment taken at 2—2 of FIG. 1.

Disposable utility lighter 10 is conventional in construction and operation as shown in FIG. 2, and is comprised of a fluid reservoir 26, providing fluid through tube 28 to nozzle tip 16, which is ignited by a spark at spark gap 30. Fluid is released to nozzle tip 16 by trigger 18, engaging lever 34 to open valve 36, allowing fluid to flow from fluid reservoir 26 through tube 28 to nozzle tip 16. Nearly simultaneously, trigger 18 activates spark generator 25 to generate a spark at spark gap 30. This construction is conventional in nearly all disposable utility lighters.

A unique feature of the invention is the child resistant trigger lock and release mechanism 24, comprised of a button 38, that must be pushed upward simultaneously with operation of trigger 18 to allow ignition of a flame. Trigger release button 38 has a curved surface to fit a finger placed beneath trigger guard 20 on trigger 18, and includes a cylindrical portion 40, having a socket 42 for receiving a spring 44. Preferably, socket 42 has a post 46 fitting inside to center coil spring 44 and prevent it from slipping out of socket 42. Coil spring 44 has one end seated in socket 42 and the other end in abutment with housing 12.

Trigger release button 38 also has an extension 48, that includes an abutment 50, extending over and around an edge 52 of flange 53 on trigger 18. Abutment 50 prevents trigger 18 from being operated until release button 38 is pressed.

Figure 4:
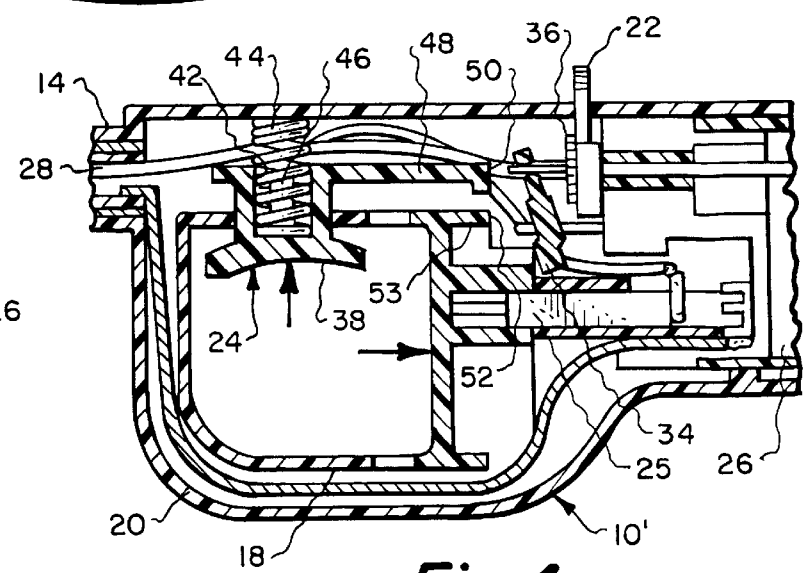
FIGS. 3 and 4 are enlarged, partial sectional views illustrating the operation of a first embodiment of the invention.
Figure 3:
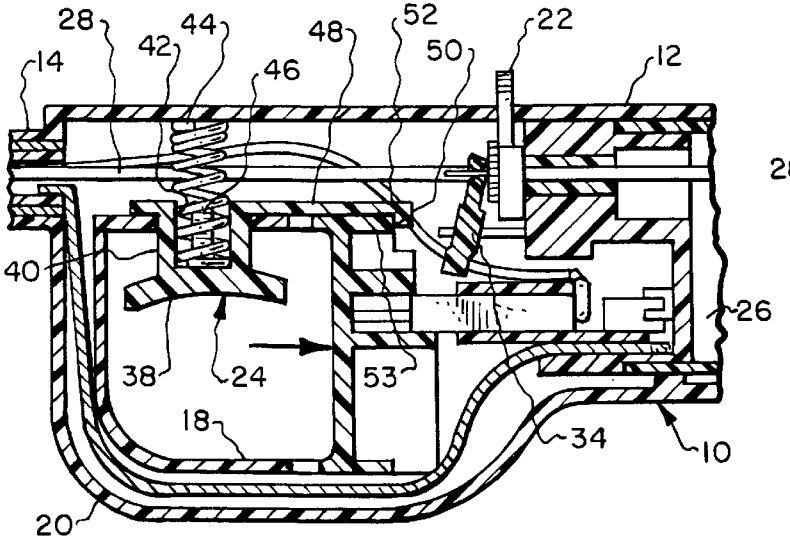

The operation of the first embodiment of a child resistant device for utility lighters is shown in the enlarged partial sectional view of FIGS. 3 and 4. As can be seen in FIG. 3, attempts to pull trigger 18 back, as indicated by the arrow causes edge 52 of flange 53 on trigger 18 to engage abutment 50 on plate 48, extending rearward from trigger release button 38. This will prevent operation of the BBQ lighter. Also, attempting to pull trigger 18 backward, before releasing trigger release button 38 will make it more difficult to release the trigger because of the force of the edge 52 of trigger flange 53 on abutment 50.

To properly operate the device and ignite a flame, trigger release button 38 must be pushed upward by a finger before, or almost simultaneously with a rearward force on trigger 18, as indicated by the arrows. An upward force on abutment 38 retracts abutment 50 on plate 48 away from edge 52 on trigger 18, allowing the trigger to continue in its rearward motion. Trigger 18 will then continue in a rearward direction engaging latch 34, to release fluid from reservoir 26, through valve 36 into tube 28 for delivery to nozzle 16. Nearly simultaneously, continuous rearward motion of trigger 18 activates spark generator 25 connected to spark gap 30, creating a spark which ignites the fluid, creating a flame.

The size and intensity of the flame is regulated by operation of tab or dial 22 to vary the amount of lighter fluid delivered from reservoir 26. The flow adjusting dial 22 cannot be operated before or after ignition as desired. If the user is having trouble igniting the flame, the flow can be increased or decreased as desired. Optionally, the flame can be increased after ignition by operation of dial 22.

Figure 5:
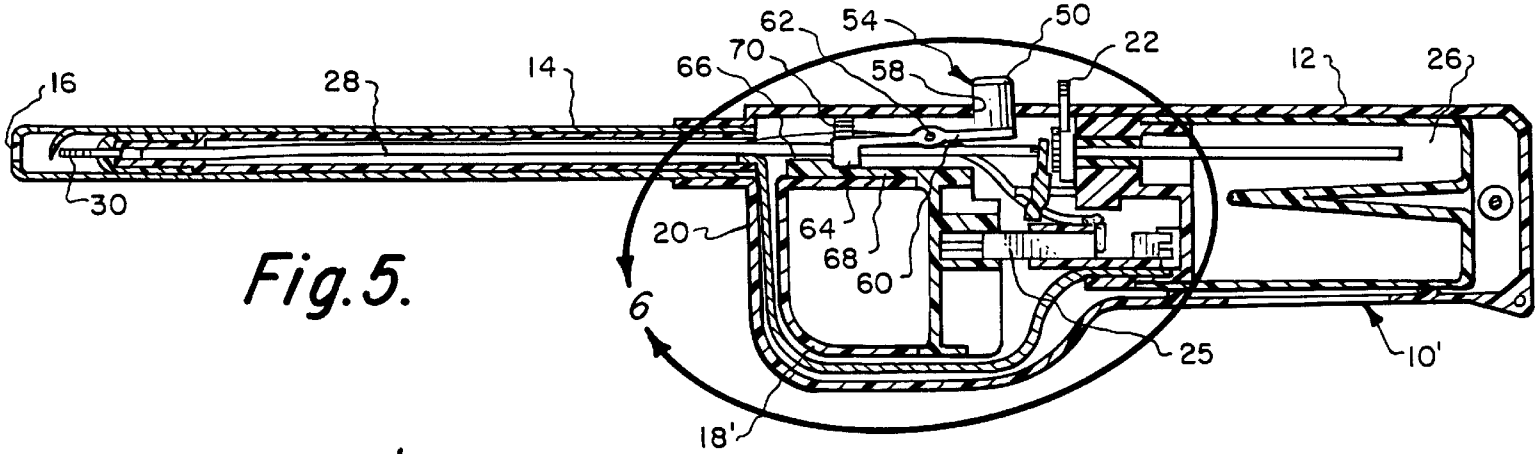
FIG. 5 is a sectional view similar to FIG. 2 illustrating a second embodiment of the invention.
Figure 7:
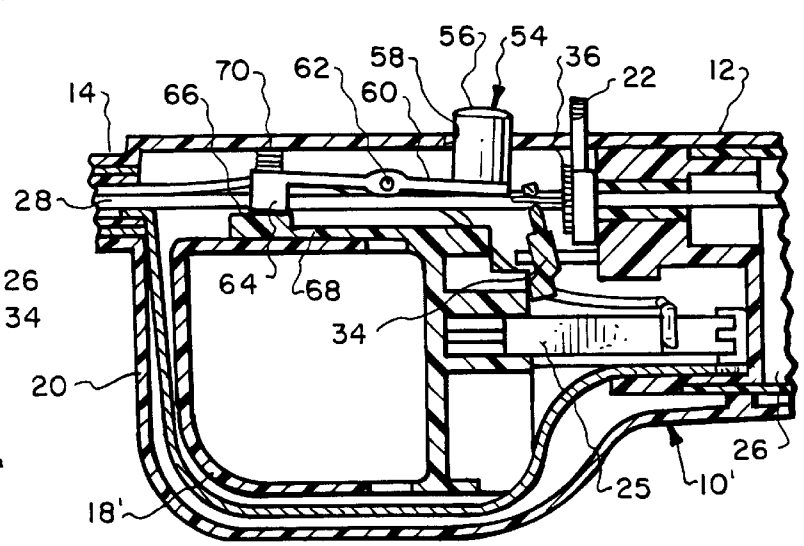
FIGS. 6 and 7 are enlarged partial sections taken at 6—6 of FIG. 5 illustrating operation of the second embodiment of the invention.
Figure 6:
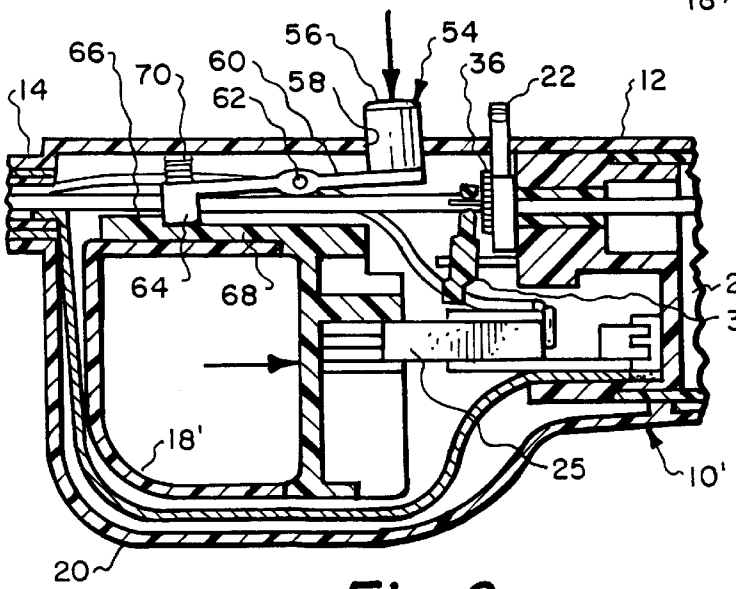
Figure 8:
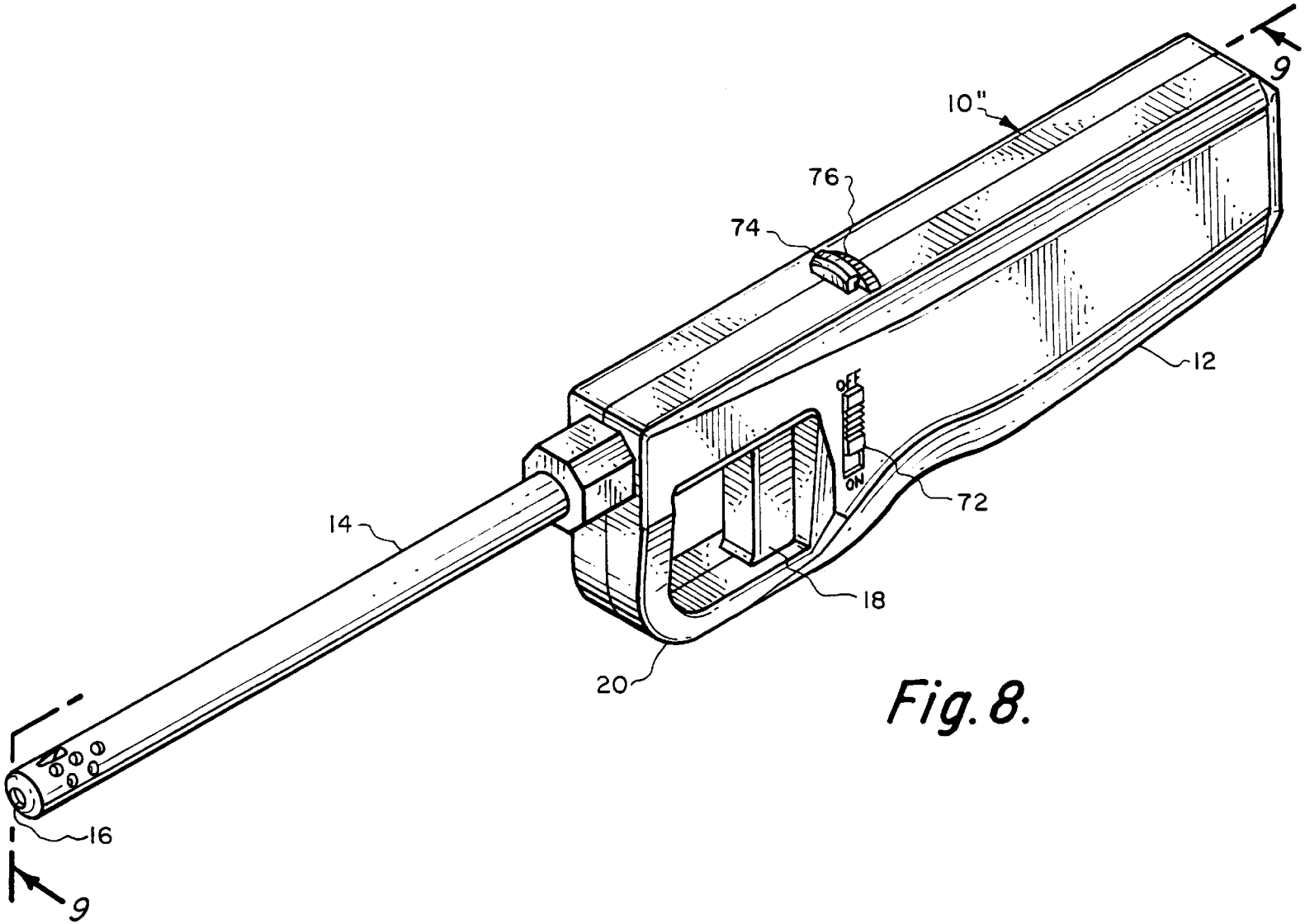
FIG. 8 is an isometric view of the third embodiment of the invention.

A second embodiment of the invention is illustrated in FIGS. 5 through 7. In this embodiment, the general construction and operation of the utility lighter is substantially the same with the exception of the child resistant device. Utility lighter 10' has a housing 12, nozzle 14, nozzle tip 16, trigger 18' beneath trigger guard 20, flow adjusting dial 22, spark gap 25 and reservoir 26 as before. The only difference in this embodiment is a slight modification in the construction of trigger 18' and the addition of a different child resistant device 54. The advantage of this embodiment is its elegant simplicity because it is constructed of a lever or rocker 60 mounted on a pivot pin 62, having a button 56 extending through an aperture or hole 58 in housing 12. On the other end of lever 60 is an abutment 64 engaging a boss 66 on trigger plate flange 68. Abutment 64 is biased into engagement with boss 66 by coil spring 70; thus, coil spring 70 maintains abutment 64 in engagement with boss 66 on trigger 18' until released by a force on abutment 56.

The operation of the second embodiment is shown in greater detail in the enlarged partial sectional view of FIGS. 6 and 7. Abutment 64, on child resistant trigger release 54 engaging boss 66 on trigger 18', prevents operation of the trigger. To release the trigger, button 56 must be pushed downward as indicated by the arrow, disengaging abutment 64 from boss 66 allowing trigger 18' to travel rearward as shown in FIG. 7. The rearward travel of trigger 18' trips latch or lever 34, opening valve 36, allowing lighter fluid to flow from reservoir 26 through tube 28 to nozzle tip 16.

Nearly simultaneously, the rearward motion of trigger 18' activates spark generator 25, creating a spark at spark gap 30 igniting the fluid. The size and intensity of the flame is, as before, regulated by rotation of dial 22 extending through the top of housing 12. Trigger 18' must be held in an activated position to keep valve 36 open as long as a flame, at nozzle tip 16 is needed. Once trigger 18' is released, it returns to the rest position as shown in FIG. 6, and spring 70 biases abutment 64 back into engagement with boss 66; again, locking the trigger against operation.

The child resistant device of this embodiment is an elegantly simple construction of a lever or rocker 60 on pivot pin 62 having an operating button 56 on one end and an abutment 64 on the other end, biased into engagement with boss 66 on trigger 18' by coil spring 70. This means, the child resistant device is constructed of three very simple parts, of lever 60 with the abutment on one end and button on the other; pivot pin 62 and coil spring 70.

A third embodiment of a utility lighter, having a child resistant device to prevent operation is illustrated in FIGS. 8 through 11. Utility lighter 10" is comprised of a housing 12, nozzle 14, having nozzle tip 16 and trigger 18 as before. Trigger 18 is protected by a trigger guard 20. However, in this embodiment, instead of having a trigger locking device, an on/off switch 72 is provided which locks trigger 18, preventing operation of utility lighter 10". In addition to on/off switch 72, a valve control lever 74, adjacent to valve flow control regulator dial 76 is provided. Valve control lever controls the flow of lighter fluid from reservoir 26 (FIG. 9) to nozzle tip 16, as will be described in greater detail hereinafter.

Preferably, valve lever extends through the top of utility lighter housing 12 immediately adjacent flow control regulator dial 76. This simplifies construction because both valve lever 74 and regulator dial 76 may extend through the same hole 75 in housing 12.

Figure 9:
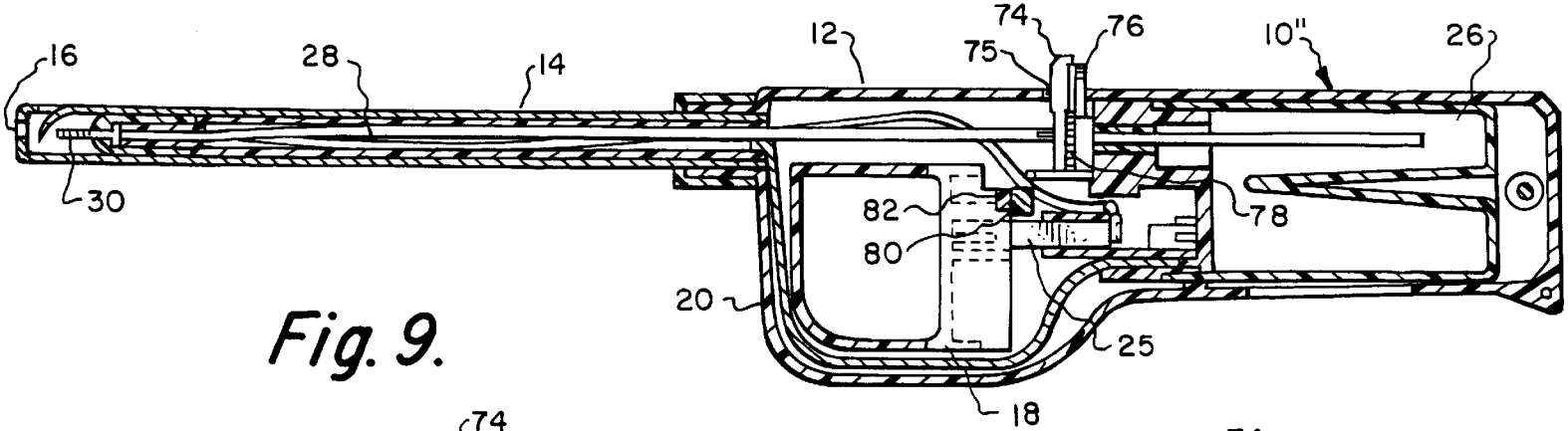
FIG. 9 is a sectional view taken at 9—9 of FIG. 8.
Figure 10:
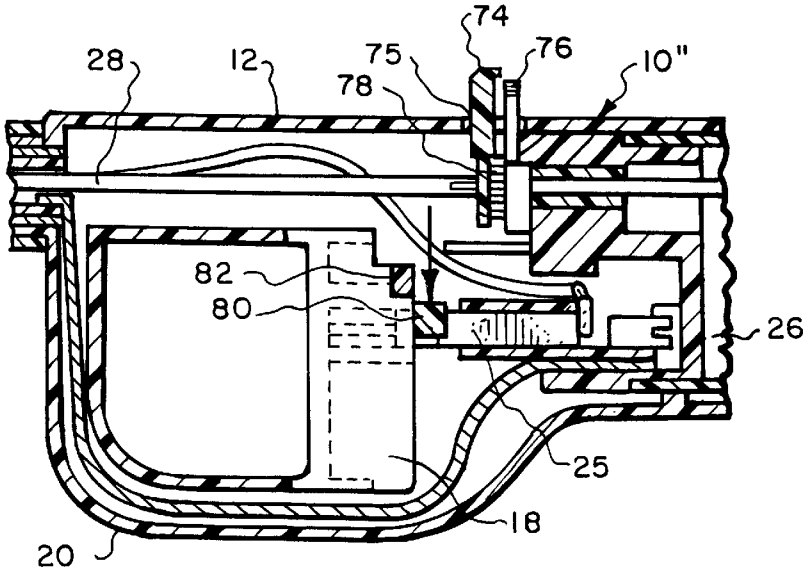
FIGS. 10 and 11 are enlarged partial sections illustrating operation of the third embodiment of the invention.
Figure 11:
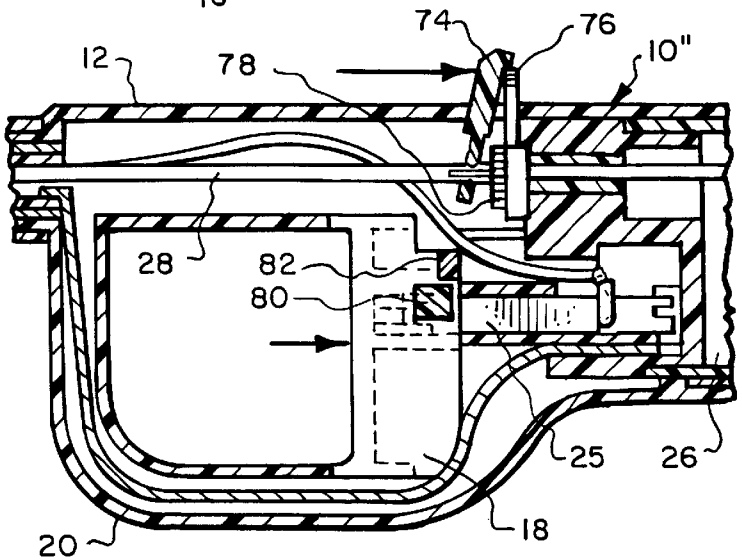

The details of the construction and operation of the child resistant in the third embodiment is illustrated in the sectional views of FIGS. 9 through 11. Utility lighter 10" has a reservoir 26 for delivering fluid through tube or conduit 28 to nozzle tip 16 for ignition by spark 30 generated by spark generator 25. As before, operation of trigger 18 activates spark generator 25, generating a spark at spark gap 30 to ignite fluid exiting nozzle 16. However, the difference in this embodiment over the previous embodiments is that trigger 18 does not release any lighter fluid from reservoir 26 to nozzle tip 16 through tube 28.

Instead of allowing trigger 18 to automatically release fluid from reservoir 26 through tube 28 through nozzle tip 16, a manually operated system is provided. This system is comprised of a valve handle or lever 74 adjacent valve regulator dial 76 to release fluid from reservoir 26 through valve 78 to tube 20. Unless valve lever or handle 74 is operated simultaneously with operation of trigger 18, no fluid flows to nozzle tip 16, and no ignition can take place when a spark is generated by spark generator 25 at spark gap 30.

Additionally, trigger 18 may not be operated until on/off switch 72 is turned to the on position. On/off switch 72 has a post 80 abutting a flange or edge 82 on trigger 18, as shown in FIG. 9 to prevent movement of the trigger. When on/off switch 72 is slid downward to the on position, post 80 is disengaged from flange 82 allowing trigger 18 to move rearward as shown in FIG. 11. This activates spark generator 25, generating a spark at spark gap 30 to ignite a flame.

The operation of the third embodiment is illustrated in greater detail in FIGS. 10 and 11. FIG. 10 illustrates the operation of on/off switch 72 from an off position to an on position, disengaging post 80 from flange 82 on trigger 18, releasing the trigger. As long as on/off switch 72 remains in the on position, trigger 18 cannot be operated to activate spark generator 25.

Ignition at nozzle tip 16 by a spark at spark gap 30, will not occur until fluid is released from reservoir 26. In this embodiment, operation of valve lever or handle 74, by pulling it backward toward regulator dial 76, opens valve 78 releasing fluid from reservoir 26 through tube 28 to nozzle tip 16 adjacent to spark gap 30. Manual operation of lever 74 to release fluid from reservoir 26 to valve 78 takes place either before or simultaneously with operation of trigger 18, after the trigger is unlocked by turning switch 72 to the "on" position. With lever 74 pulled backward as illustrated in FIG. 11, opening valve 78 lighter fluid exits tube 28 and nozzle tip 16 for ignition by a spark generated by spark generator 25. Operation of trigger 18 activates spark generator 25 generating a spark at spark gap 30 to ignite the fluid flowing through tube 28. Release of lever 74 closes valve 78, cutting off fluid from reservoir 26 to nozzle tip 16, extinguishing any flame. Thus, a valuable safety feature if this embodiment is that lever 74 must be held back to maintain the flame at nozzle tip 16.

Figure 12:
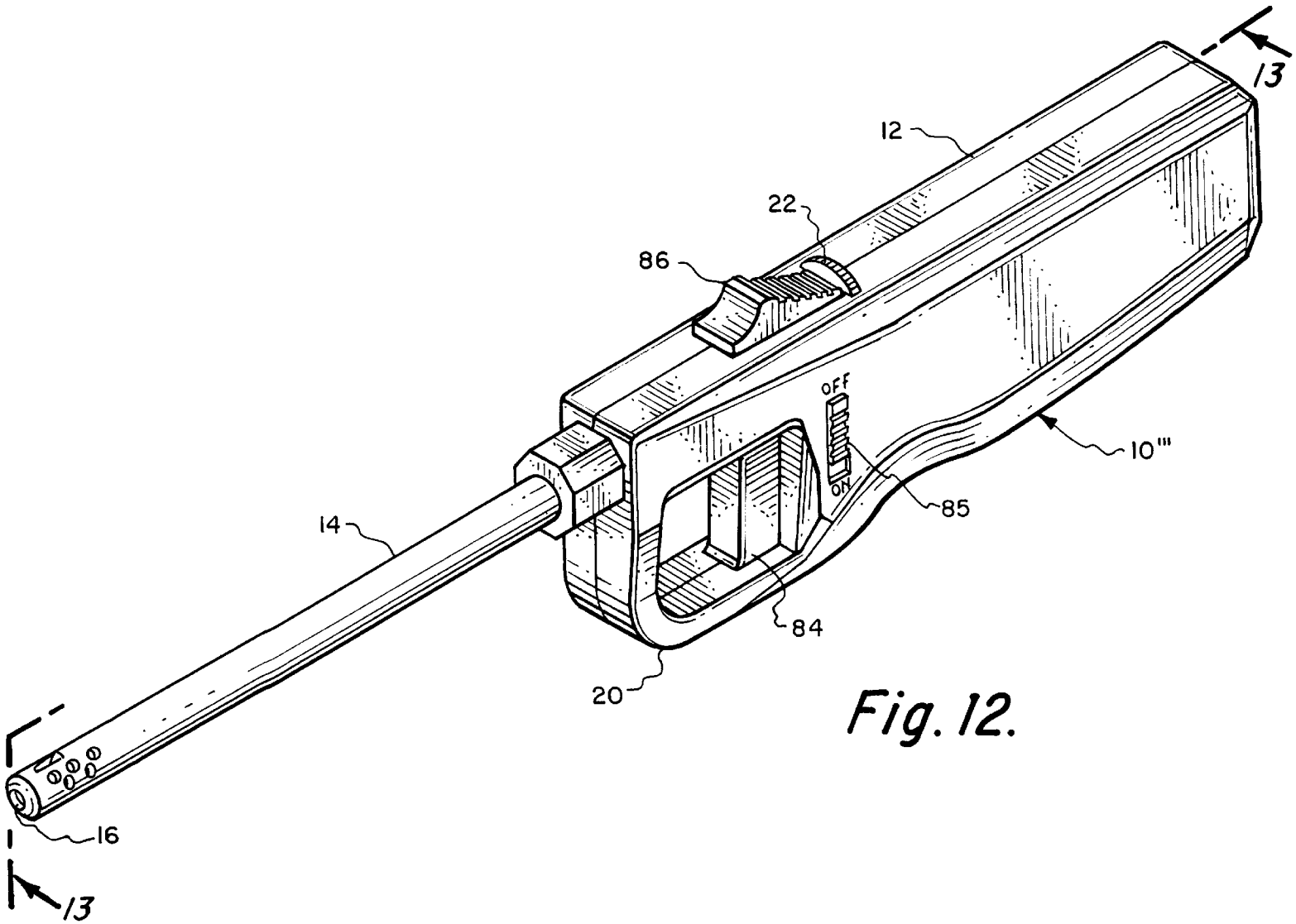
FIG. 12 is an isometric view of the fourth embodiment of the invention.

Another optional but preferred embodiment is illustrated in FIG. 12. This embodiment provides a utility lighting device 10''' having a housing 12 nozzle 14 and ignition tip 16 as before. The flow of fuel from the reservoir to ignition tip 16 is controlled by fuel regulator 22. Rotation of regulator 22 increases and decreases the amount of fuel flowing to the tip for ignition. However, the difference in this embodiment is that trigger 84 is not used to ignite the fuel but is used to release fuel to ignition tip 16. Ignition is initiated by button 86 on top of housing 12 of utility lighter 10''' as will be described in greater detail hereinafter.

Figure 13:
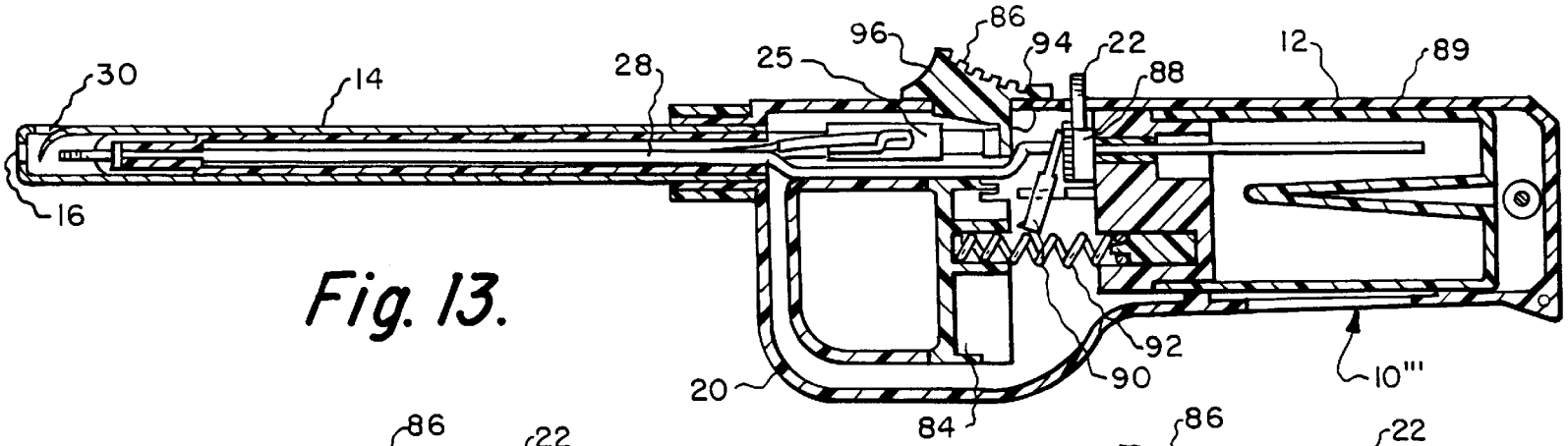
FIG. 13 is a sectional view taken at 13—13 of FIG. 8.
Figure 15:
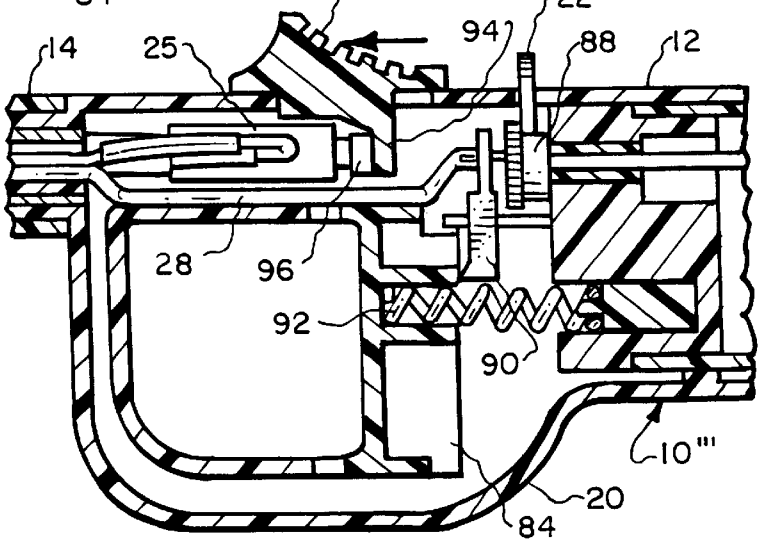
FIGS. 14 and 15 are enlarged partial sections illustrating operation of the third embodiment of the invention.
Figure 14:
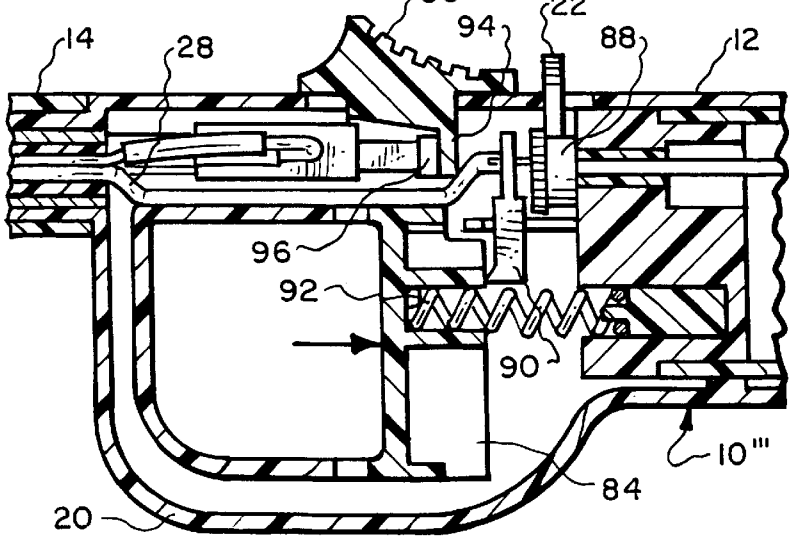

The details of the fourth embodiment are illustrated in FIGS. 13 through 15. The unique safety advantage of the fourth embodiment is the manipulation of a trigger in one direction to release fuel and a button in opposite direction to ignite the fuel at nozzle tip 16. This makes it very difficult for a child to accidentally ignite. It takes considerable dexterity to manipulate the trigger while simultaneous manipulating an ignition button in an opposite direction. Trigger 84 is connected to fuel valve 88 on fuel reservoir 89 which is operated by fuel lever 90. Spring 92 biases trigger 84 away from lever 90 closing valve 88 when trigger 84 is released.

Ignition button 86 is moved axially forward on body 12 to activate piezoelectric spark generator 25 to generate a spark at spark gap 30. Ignition button 86 has an abutment 94 that engages a spring-loaded pin 96 on piezoelectric igniter 25. It takes a sharp, quick forward force on ignition button 86 to generate a spark at spark gap 30.

The operation of the fourth embodiment is illustrated in FIGS. 14 and 15. To ignite the utility lighter, trigger 84 is pulled backwards against the force of spring 92 engaging lever 90 to open valve 88 releasing lighter fluid to tip 14 through tube 28. While trigger 84 is held in an "on" position with valve 88 "on" ignition button 86 is moved quickly forward against pin 96 of piezoelectric igniter 25 creating a spark at spark gap 30 igniting the fuel delivered to tip 16 of nozzle 14.

Thus the device of the invention controls the release of fuel to igniter tip 16 by motion in one direction and ignition by motion on an ignition button in an opposite direction. This is a difficult manipulation for tiny hands of children. Further, trigger 84 must be continuously held in an "on" position to supply fuel to nozzle tip 16. Also spring 92 is constructed to have a biasing force that makes it difficult for children to manipulate trigger 84 as well as hold it in an "on" position while manipulating ignition button 86.

Thus, there has been described disposable utility lighters for lighting BBQs, fireplaces and the like, having child resistant devices to prevent or discourage use by children. In a first embodiment, the child resistant device is in the form of a button mounted beneath a trigger guard immediately adjacent to and above the trigger that must be operated simultaneously or before operation of the trigger. An advantage of this embodiment is that it may be operated with one finger placed on the trigger. A simultaneously upward motion against the trigger release button, followed by a rearward motion of the finger activates the device. This is a rather complex movement for a child, but relatively simple for an adult and effectively discourages and prevents use by children.

In a second embodiment, elegantly simple in its construction, a lever or rocker arm is pivotally mounted on a pin inside the housing above a trigger. An abutment on the lever engages a boss formed on the trigger, and is biased into engagement by a coil spring. A button on an end of the lever, extending through an opening in the housing, allows the abutment to be disengaged from the trigger. To operate this device, a downward force on the button pivots the lever on the pivot pin releasing the abutment from the boss, allowing rearward movement of the trigger to ignite the lighter. Release of the trigger causes a coil spring to re-engage the abutment on the lever with the boss on the trigger, relocking the trigger and preventing operation.

In a third embodiment of the invention a child resistant device is provided for a utility lighter by an on/off switch that locks the trigger and a valve lever that manually controls the release of lighter fluid from a reservoir to the nozzle tip. The on/off switch must be first turned to the "on" position to release the trigger before operation can take place. The valve lever can then be manually operated to release fluid from the reservoir to the nozzle tip for ignition when the trigger activates the spark generator to generate a spark. Valve lever must be manually held in the on position to maintain the flow of fluid from the reservoir to the nozzle tip. A valve regulating dial is provided to control the volume of flow to the nozzle tip.

In a fourth embodiment of the invention a child resistant utility lighter is provided having activating trigger and an ignition button that require opposite forces to manipulate. In this embodiment the trigger operates a valve to release fuel from a reservoir to the nozzle tip while an ignition button on top of the housing for the utility lighter is manipulated in the opposite direction to generate a spark at a spark gap. Further, the trigger must be held in an "on" position to maintain the flame at the nozzle tip. Thus to operate the device of this embodiment opposite forces are required to release fuel and ignite the fuel. The trigger must be pulled backward while the ignition button must be moved forward. Such an arrangement is difficult for a child to achieve even using two hands assuming they can figure out how to manipulate the device. The spring return for the trigger is made strong enough that it also makes it difficult for a child to hold the trigger in an "on" position.

A locking switch may or may not be used with the device of FIG. 13. Locking switch 85 is used to lock trigger 84 to prevent release of fuel accidentally. This may be used as an additional safety device to prevent use by children.

This invention is not to be limited by the embodiment shown in the drawings and described in the description which is given by way of example and not of limitation, but only in accordance with the scope of the appended claims.

What is claimed is:

1. An elongate utility lighter for igniting a flame to light BBQs, fireplaces and the like comprising;

a housing forming a handle having a top, bottom and sides;

a nozzle extending away from said handle having a nozzle tip;

a lighter fluid reservoir in said handle;

a tube for delivering said lighter fluid from said reservoir to said nozzle tip;

a trigger for releasing lighter fluid from said reservoir through said tube to said nozzle tip;

spark generating means in said handle; said spark generating means comprises a piezoelectric spark generator in said housing; said piezoelectric spark generator having a spring biased activating pin; said spring bias activating pin engaging an abutment on said ignition button; said activating pin facing backward whereby a forward force on an ignition button is required to initiate a spark;

said ignition button is located on top of said housing for activating said spark generating means in said housing;

said trigger constructed and arranged to require a force in a first direction and said ignition button constructed and arranged to require a separate force in a direction opposite to the force applied to said trigger to release and ignite fuel at said nozzle tip;

whereby said trigger for releasing fuel and said ignition means require operation by separate forces in opposite directions to ignite a flame at said nozzle tip.

2. The utility lighter according to claim 1 in which said trigger for releasing fuel includes a spring biasing said trigger out of engagement with a fuel release valve; said spring having a force sufficient to discourage use by children.

* * * * *